US011085590B2

(12) United States Patent
Ramaiah et al.

(10) Patent No.: US 11,085,590 B2
(45) Date of Patent: Aug. 10, 2021

(54) GLASS LED ASSEMBLY

(71) Applicant: Consumer Lighting (U.S.), LLC, Norwalk, CT (US)

(72) Inventors: Raghu Ramaiah, East Cleveland, OH (US); Zhiyong Wang, Shanghai (CN); Kun Xiao, Shanghai (CN); Zhifeng Bao, Xian (CN); Xiaojun Ren, Shanghai (CN)

(73) Assignee: Savant Technologies LLC, East Cleveland, OH (US)

( * ) Notice: Subject to any disclaimer, the term of this patent is extended or adjusted under 35 U.S.C. 154(b) by 0 days.

(21) Appl. No.: 16/492,604

(22) PCT Filed: May 11, 2017

(86) PCT No.: PCT/CN2017/083937
§ 371 (c)(1),
(2) Date: Sep. 10, 2019

(87) PCT Pub. No.: WO2018/205223
PCT Pub. Date: Nov. 15, 2018

(65) Prior Publication Data

US 2020/0248876 A1 Aug. 6, 2020

(51) Int. Cl.
*F21K 9/232* (2016.01)
*F21V 3/02* (2006.01)
(Continued)

(52) U.S. Cl.
CPC ..... *F21K 9/232* (2016.08); *F21V 3/02* (2013.01); *F21V 9/00* (2013.01); *F21V 29/506* (2015.01); *F21V 31/005* (2013.01)

(58) Field of Classification Search
CPC ..... F21K 9/232; F21V 29/506; F21V 3/02; F21V 9/00; F21V 31/005
See application file for complete search history.

(56) References Cited

U.S. PATENT DOCUMENTS 8,866,380 B2 10/2014 Hikmet et al.
9,851,055 B2 12/2017 Gielen
(Continued)

FOREIGN PATENT DOCUMENTS

CN 103154186 A 6/2013
CN 106015981 A 10/2016
(Continued)

OTHER PUBLICATIONS

International Search Report and the Written Opinion of the International Searching Authority from International Appl. No. PCT/CN2017/083937, dated Feb. 9, 2018.
(Continued)

*Primary Examiner* — Anabel Ton
(74) *Attorney, Agent, or Firm* — Wood IP LLC

(57) ABSTRACT

The present disclosure includes an LED lamp assembly comprising a glass envelope, an LED platform supported by a stem arrangement disposed within the envelope, a base hermetically sealed to the envelope, a gas disposed within the envelope providing thermal conductivity between the LED platform and the envelope, and a getter disposed within the envelope for absorbing volatile organic compounds. The lamp may maintain a ratio of helium to oxygen that achieves both an acceptable thermal conductivity and an acceptable lumen output over the life of the LED lamp.

18 Claims, 9 Drawing Sheets

(51) Int. Cl.

| | |
|---|---|
| ***F21V 9/00*** | (2018.01) |
| ***F21V 29/506*** | (2015.01) |
| ***F21V 31/00*** | (2006.01) |

(56) References Cited

U.S. PATENT DOCUMENTS

| | | | | |
|---|---|---|---|---|
| 2017/0179359 | A1* | 6/2017 | Lunz | H01L 25/0753 |
| 2017/0268730 | A1* | 9/2017 | Cai | F21K 9/232 |
| 2017/0276300 | A1* | 9/2017 | Koole | F21V 29/70 |
| 2019/0331302 | A1* | 10/2019 | Cai | F21V 29/70 |

FOREIGN PATENT DOCUMENTS

| | | | |
|---|---|---|---|
| CN | 106233063 | A | 12/2016 |
| JP | 2016012467 | A | 1/2016 |
| JP | 2016225315 | A | 12/2016 |
| WO | 2018205223 | A1 | 11/2018 |

OTHER PUBLICATIONS

Chinese Office Action Received for Chinese Patent Application 201780090587.1 dated Apr. 15, 2020, 12 Pages (6 pages Official Copy + 6 Pages English Translation).

* cited by examiner

GLASS LED ASSEMBLY

BACKGROUND

Traditional incandescent and halogen light bulbs create light by conducting electricity through a resistive filament, and heating the filament to a very high temperature so as to produce visible light. The incandescent lamps typically include a transparent glass enclosure with a tungsten filament inside, a glass stem with lead wires, and a medium base for electrical connection. The halogen lamps also typically include a glass enclosure, a glass stem, a medium base and a capsule light engine with one or more filaments and halogen vapor inside. Nowadays incandescent and halogen lamps are being replaced by LED lamps, mainly because LED lamps are much more efficient and save energy, and usually have a much longer service life.

At present, LED lamps with plastic envelopes are available in the market which include a light engine having LED light sources mounted on a metal core printed circuit board, a heat sink thermally coupled with the light engine, a driver inside the heat sink, a base, and a translucent and diffusive envelope. Electrical AC mains power is connected to the base, and the driver converts the AC mains power to direct current to drive the LEDs at a given power and to generate visible light. The light passes through the diffusive plastic envelope to provide a diffuse illumination. During operation, the LED's generate visible light as well as thermal energy. Some of the thermal energy is removed from the LED's by the heat sink. The heat sink thermals are dissipated somewhat by radiation and convection. Without the heat sink, the LED temperature may rise to a point where its service life is shortened, and may even be damaged.

Compared to LED lamps with plastic envelopes, traditional gas filled glass envelope incandescent and halogen lamps still have several merits. They typically have near-4π light distribution which is suitable for most applications. The material cost of the incandescent and halogen lamps is much cheaper, compared to the LED lamps described above. Also they are simple in structure and the manufacturing technology of these lamps is well developed and highly automated, further reducing the cost of these lamps to the consumer.

Recently, filament style LED lamps have been produced that attempt to leverage the merits of the incandescent and halogen lamps. Filament style LED lamps typically include gas tight glass envelopes, LED filament packages, and a gas disposed within the envelopes to dissipate heat. A number of LED dies are placed in a transparent strip substrate and coated with a mixture of phosphor and silicone to form the LED filament. These style lamps generally have near-4π angular light distribution (sometimes referred to as "omnidirectional"), are light weight and have a simple structure. However, the typical filament LED lamp is usually higher in cost because it uses a large number of costly LED dies. Because the envelope is sealed, provisions must be made to dissipate the heat generated by the LEDs. The ability to provide a similar amount of lumens in a package similar to those presently in use would be advantageous. Providing a sealed glass envelope LED lamp that manages heat dissipation, in addition to utilizing present well developed and automated manufacturing technology would also be advantageous.

SUMMARY

It has been ascertained that many of the components of LED lamps, such as encapsulation materials, integrated circuits, printed circuit boards, solder, insulation, conformal coatings, and adhesives, may emit or "out-gas" volatile organic carbons (VOCs) during operation. The VOCs cause surface contamination and degrade the lumen output of the LED light sources over time. To overcome this problem and other problems of traditional LED lamps with plastic envelopes, LED filament lamps, and sealed glass LED lamps in general, the disclosed embodiments provide a LED lamp that is light weight, has a simple structure, and lower cost with heat and VOC production management features.

The disclosed embodiments are directed to an LED lamp assembly that includes a glass envelope, an LED platform supported by a stem arrangement disposed within the envelope, a base hermetically sealed to the envelope, a gas disposed within the envelope providing thermal conductivity between the LED platform and the envelope, and a getter disposed within the envelope for absorbing volatile organic compounds.

The getter may include an oxygen generating material.

The LED platform may include a metal core printed circuit board formed into a shape with multiple sides with LED light sources mounted on exterior surfaces of the multiple sides.

The getter may be mounted on at least one of the exterior surfaces of the multiple sides using one or more surface mounting pads.

The getter may be mounted on at least one of the exterior surfaces of the multiple sides by one or more flanges inserted into corresponding slots of the exterior surfaces.

The getter may be implemented as a deposit of oxygen generating material in a recess on at least one of the exterior surfaces.

The getter may be mounted on the stem arrangement disposed within the envelope.

The LED platform may include an LED filament arrangement and the getter may be mounted on the stem arrangement and disposed within the LED filament arrangement.

The getter may be implemented as an oxygen generating material applied as a coating on the stem arrangement.

The gas disposed within the envelope may include a selected ratio of helium to oxygen that achieves the thermal conductivity and provides a predetermined lumen output over a predetermined time period, and the getter may include a material that generates oxygen to maintain the ratio.

The getter may be temperature activated and selected dimensions of the LED platform may provide a heat dissipation that maintains a temperature of the getter within a range that provides the selected ratio of helium to oxygen.

Selected dimensions of the LED platform may provide a convective heat transfer within the envelope to maintain a consistent temperature throughout the interior of the envelope.

The gas disposed within the envelope may include a ratio of between 80% helium to 20% oxygen.

The gas disposed within the envelope may include a ratio of 85% helium to 15% oxygen.

The gas disposed within the envelope may include a ratio of between 80% helium to 20% oxygen and 85% helium to 15% oxygen.

The disclosed embodiments are also directed to an LED lamp assembly that includes a glass envelope, an LED platform supported by a stem arrangement disposed within the envelope, a base hermetically sealed to the envelope, a gas mixture disposed within the envelope having a helium-oxygen ration for providing thermal conductivity between the LED platform and the envelope and for absorbing volatile organic compounds outgassed by components of the LED platform, and a getter comprising an oxygen generating material disposed within the envelope for maintaining the helium-oxygen ratio.

The getter may be mounted to a metal core printed circuit board of the LED platform, where the metal core printed circuit board has a shape with multiple sides and LED light sources mounted on exterior surfaces of the multiple sides.

The getter may be mounted on the stem arrangement disposed within the envelope and at least partially enclosed by the LED platform.

The getter may be applied as a coating on the stem arrangement and may be at least partially surrounded by the LED platform.

BRIEF DESCRIPTION OF THE DRAWINGS

The foregoing and other aspects of the disclosed embodiments are made more evident in the following detailed description, when read in conjunction with the attached figures, wherein.

DETAILED DESCRIPTION

The disclosed embodiments are directed to an LED lamp assembly that provides sufficient lumen output, thermal management, color control, and light distribution characteristics that may be manufactured using existing incandescent production techniques. Thermal management, color control, and sufficient lumen output are among the significant challenges facing most LED lamp designs, in particular applications for retrofitting existing light fixtures with LED light sources. These constraints are clearly evident when evaluating cost effective commercially available retrofit LED lamps. The disclosed embodiments are directed to an improved performance LED lamp having a low cost glass envelope and manufactured by high speed machines used for standard incandescent lamps. This existing glass envelope technology is highly desirable because the envelope is easily identified by consumers and is easily supported by current manufacturing components, machinery and techniques. For example, a halogen lamp finishing process that installs a halogen capsule inside a glass envelope may be easily adapted to install the LED platform of the disclosed embodiments. The resulting LED lamp may have a look and feel almost indistinguishable from an existing incandescent lamp, have a longer life, and may be produced at a reasonable cost.

Figure 2:
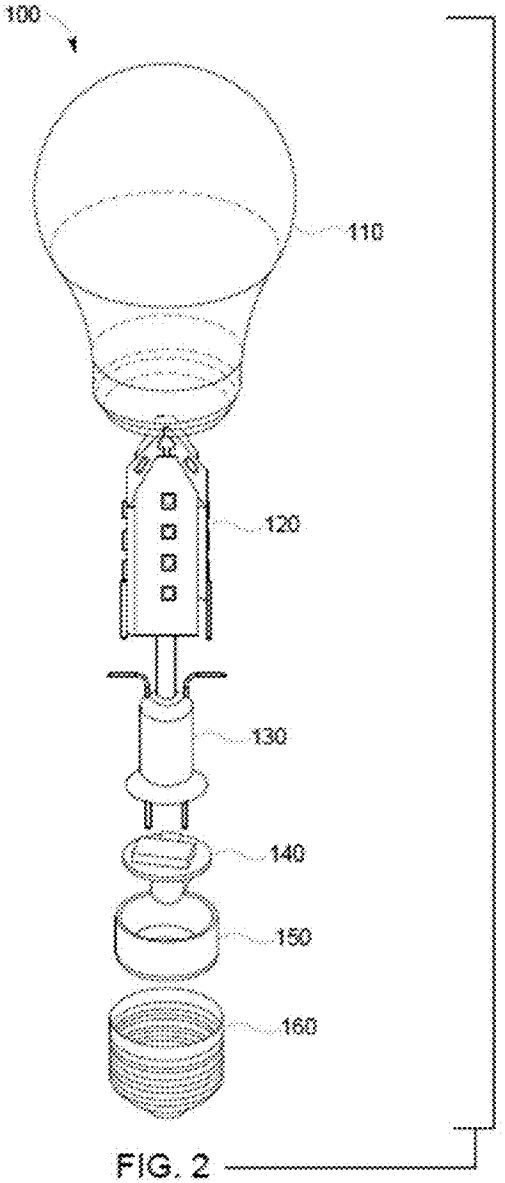
FIG. 2 is an exploded view of the exemplary LED lamp.
Figure 1:
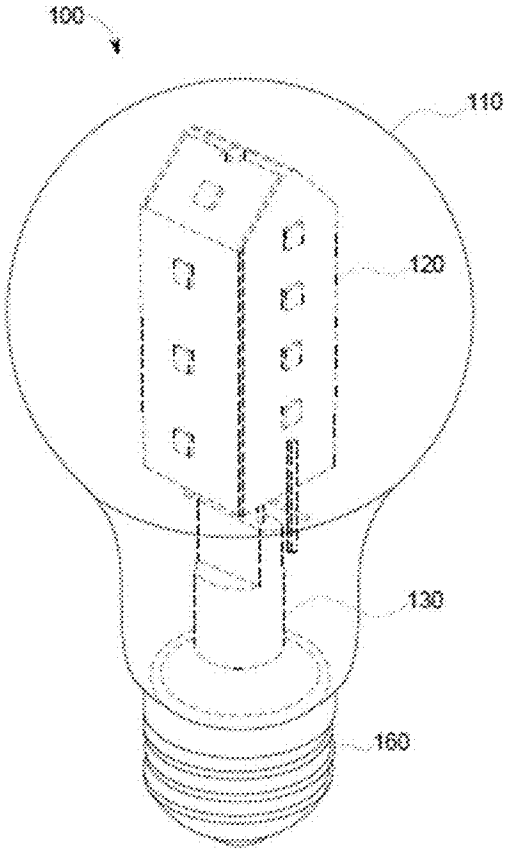
FIG. 1 shows an assembled view of an exemplary LED lamp according to one or more of the disclosed embodiments.

FIG. 1 shows an assembled view of an exemplary LED lamp 100 according to the disclosed embodiments and FIG. 2 shows an exploded view of the LED lamp 100. The LED lamp 100 may include an envelope 110, an LED platform 120, a stem arrangement 130, a power supply 140, an insulator 150, and a base 160.

The envelope 110 may generally enclose the LED platform 120 and the stem arrangement 130 and may be constructed of glass, translucent ceramic, or other suitable material for transmitting light while maintaining a gas tight or gas impermeable enclosure. While an "A" type envelope is shown, it should be understood that the disclosed embodiments may include any suitable envelope shape. At least one surface of the envelope 110 may inherently diffuse light or may include at least a partial coating, frosting, texturing, a specular coating, a dichroic coating, embedded light scattering particles, or any other surface characteristic or material for diffusing light. The surface characteristic or material may increase the light output by reducing light bounce losses. In some embodiments, the surface characteristic or material may operate to minimize or counteract any volatile organic carbon (VOC) release from components within the envelope 110. The envelope 110 may be vacuum sealed to a flange 135 of the stem arrangement and may be filled with a gas as described in detail below.

In the embodiment shown in FIGS. 1 and 2, the power supply 140 is located in the base 160 and insulated by insulator 150. In other embodiments the power supply 140 may be mounted partly or wholly within the envelope 110. In some embodiments, the power supply 140 may be incorporated as part of the LED platform 120 to facilitate installation of the LED platform 120 into the LED lamp 100 using techniques similar to those for installing a halogen capsule inside an envelope as mentioned above. As used herein, "power supply" may comprise driver circuitry and/or controller circuitry for providing power to LEDs within the envelope 110.

Figure 3:
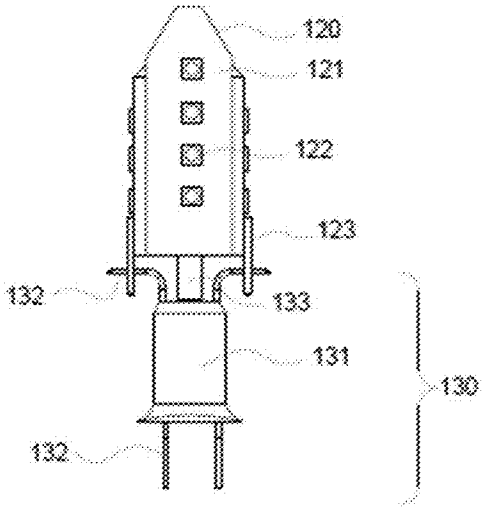
FIG. 3 shows an exemplary LED platform fixed to a stem arrangement.

Referring to FIG. 3, in some embodiments, the stem arrangement 130 may include a first support 133 mounted on a second support 131. The first and second supports 133, 131 may be composed of a rigid material, for example, glass or any suitable support material. In some embodiments, one or more of the first and second supports 133, 131 may comprise a heat conducting material, for example, a metal, for conducting heat from the LED platform 120. The first and second supports 133, 131 may each have a cylindrical, rectangular, square, or any suitable shape. A number of conductors 132 may extend through at least the second support 131 and may be connected to pins 123 on the LED platform 120 to provide support for the LED platform 120. The conductors 132 may also provide a connection to a mains supply through the base 160 of the LED lamp 100. The mains supply may typically range from 120V to 240V A.C. but may include other voltages.

Still referring to FIG. 3, in at least one embodiment, the LED platform 120 may include one or more LEDs 122 mounted on an LED mounting board 121. The LEDs 122 may comprise blue LED chips covered by one or more phosphors, a white light emitting package such as a Nichia 757 package, or any suitable LED components. The LEDs 122 may be surface mount components with a specific color temperature and a light distribution pattern of approximately 120 degrees, however, any suitable color temperature or combination of color temperatures, and any suitable light distribution pattern or combination of light distribution patterns may be used in the disclosed embodiments.

Figure 4:
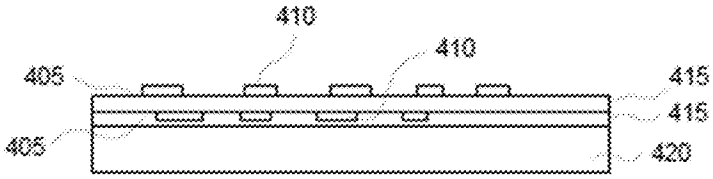
FIG. 4 illustrates an exemplary metal core printed circuit board.

The LED mounting board 121 may be made of a material suitable for mounting the LEDs and other electronic components. As shown in the example of FIG. 4, in some embodiments, the LED mounting board 121 may include one or more circuit layers 405 supporting a number of conductors 410, one or more thermally conductive but electrically insulating dielectric layers 415 and a metal layer 420 that operates as a heat sink, otherwise referred to as a metal core printed circuit board (MCPCB). The metal layer 420 may include aluminum, copper, a mixture of alloys or any suitable metallic material.

While a standard MCPCB may have an exemplary thickness of approximately 2 mm, the LED mounting board 121 of the disclosed embodiments may be flexible and bendable and may have an exemplary thickness of about 0.1 mm-0.8 mm in order to facilitate forming the LED mounting board 121 into various shapes. In some embodiments, the LED mounting board 121 may comprise a single sheet or piece formed into a shape with multiple sides for mounting the LEDs 122. While the LED mounting boards 121, and 505 described below, of the disclosed embodiments are described in terms of polygons and polyhedrons, it should be understood that the LED mounting boards 121, 505 may have any shape suitable for implementing the embodiments disclosed herein including, for example, hexagonal, cross, and herringbone shapes.

Figure 5:
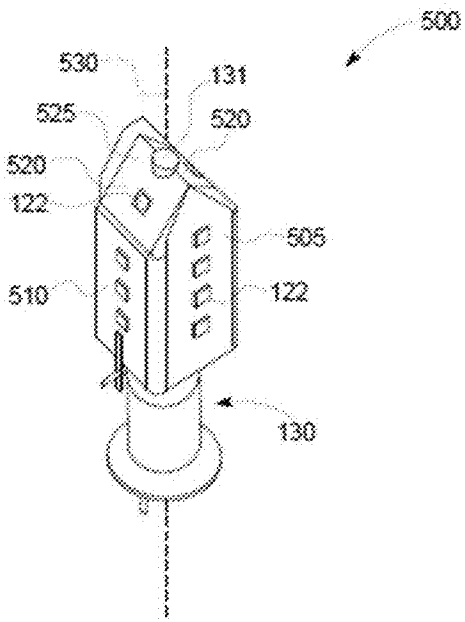
FIG. 5 shows an exemplary embodiment where the stem arrangement protrudes through a steeple structure to provide additional mechanical support.

FIG. 5 shows an exemplary embodiment where an LED platform 500 includes an LED mounting board 505 with a number of polygons 510 forming a polyhedron including surfaces 520 forming a steeple 525. The LEDs 122 may be mounted on the polygons 510 and the steeple surfaces 520 facing outward from a center 530 of the LED mounting board 505. The surfaces 520 forming the steeple 525 provide LED mounting surfaces that result in a more uniform light distribution.

While in some embodiments, support points for the LED mounting boards 121, 505 may be limited to conductors 132 connected to pins 123, in this embodiment, the steeple 525 may also provide a support point for maintaining the LED mounting board 505 in a position on the first support 133 of the stem arrangement 130. Support points for maintaining the LED mounting board 505 in position may also be provided by other structures, including one or more support wires extending from the first support 133 of the stem arrangement 130.

Returning to FIG. 1, the envelope 110 may be filled with a gas to improve heat flow from the LED platform 120 to the envelope 110. In some embodiments, the use of a low atomic weight heat transfer gas, for example helium, can provide an improved heat transport between the LED platform 120 and the envelope 110 and provide a moisture free environment within the envelope 110. According to the disclosed embodiments, the envelope 110 may be sealed (i.e., hermetically sealed) to retain the heat transfer gas (e.g., helium). The sealed envelope 110 typically has no openings to the outside environment. The conductors 132 (FIG. 3) may extend from the base 160 through the sealed envelope 110 in a fashion that does not allow leakage of the heat transfer gas out of, or allow ambient atmosphere into, the envelope 110.

Figure 6B:
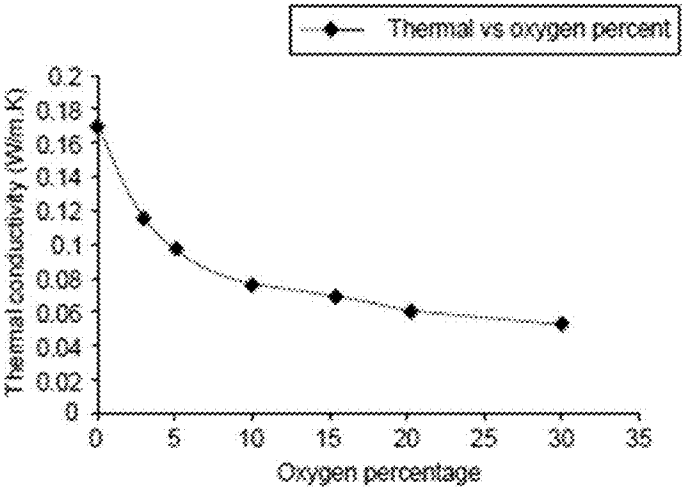
FIG. 6B illustrates the impact of oxygen content on He thermal conductivity.
Figure 6A:
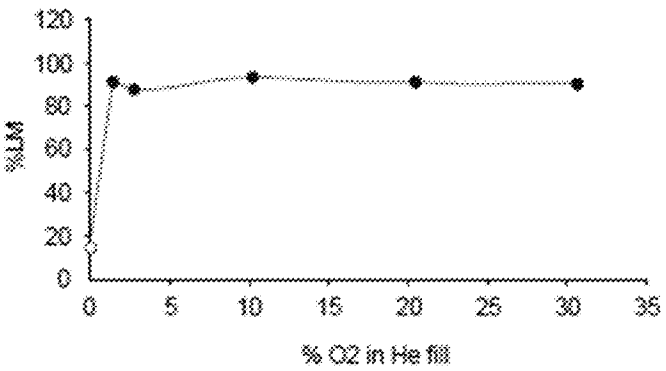
FIG. 6A shows a percentage of lumens (% LM) emitted by an exemplary LED using different concentrations of oxygen in a mixture of helium and oxygen.

As mentioned above, various components of the LED lamp 100 may release VOCs during lamp operation and degrade the lumen output of the LEDs 122. Oxygen generally reacts with VOCs to avoid the lumen degradation and chromaticity changes. FIG. 6A shows a percentage of lumens (% LM) emitted by an exemplary LED after 2000 hours using different concentrations of oxygen in a mixture of helium and oxygen. As shown in FIG. 6A, while it is possible to have little or no oxygen present within the envelope, a relatively small percentage of oxygen, for example 0.25% may dramatically reduce lumen degradation compared to using no oxygen.

As a result, it would be advantageous to maintain a mixture of gasses including at least helium and oxygen within the envelope 110. However, while helium may have higher thermal conductivity compared to other common gases such as nitrogen, neon, argon, or krypton, the presence of oxygen in the envelope may largely deteriorate the thermal dissipating capability of helium. Referring to the example shown in FIG. 6B, with a 30% volume of oxygen, the thermal conductivity of the mixed gas at 85° C. may decrease from approximately 0.18 W/m-K to approximately 0.06 W/m-K, that is, a decrease in thermal conductivity of around 60%. While this may be acceptable in certain LED lamp designs, a ratio of helium to oxygen should be selected that achieves both an acceptable thermal conductivity and an acceptable lumen output over the life of the LED lamp 100.

Referring again to FIG. 6B, in one example embodiment, as long as the oxygen content remains at approximately 30%, resulting in the thermal conductivity of the gas mixture being maintained at or above approximately 0.06 W/m-K, enough oxygen is present in the envelope to react with the VOCs such that the life of the LED lamp will not be compromised. For example, using a 60 W equivalent LED lamp design with a rated output of 800 lumens, the oxygen percentage may be above 10%, and the oxygen percentage may be even higher for larger lumen design lamps. Thus, a wide range of ratios of helium to oxygen may be utilized depending on the thermal conductivity and lumen output required over the life of the LED lamp. For example, in some embodiments, a 70% to 30% ratio of He to $O_2$ may be used, while in at least one embodiment, an 80% to 20% ratio of He to $O_2$ may be used. In one or more embodiments, an 85% to 15% ratio of He to $O_2$ may be used, or even a 99.75% to 0.25% ratio of He to $O_2$. In at least one embodiment, the gas disposed within the envelope may be maintained within a range of ratios of between 70% helium to 30% oxygen and 95% helium to 5% oxygen. While different ratios of helium and oxygen are disclosed, it should be understood that any ratio of helium and oxygen may be utilized as long as a suitable thermal conductivity and lumen output may be maintained over a desired life of the LED lamp. Thus, the gas maintained within the envelope optimally comprises a selected ratio of helium to oxygen that achieves both a predetermined thermal conductivity and a predetermined lumen output over a predetermined time period.

Figure 8B:
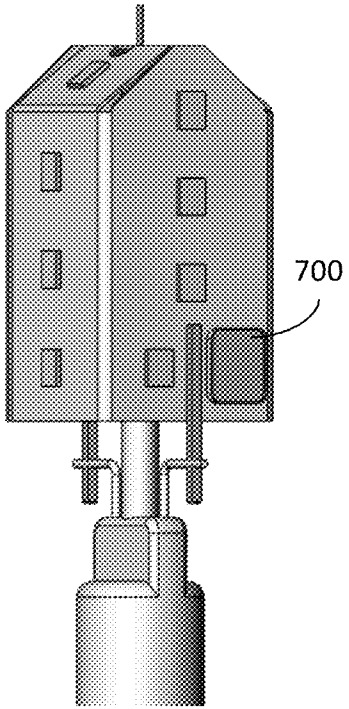
FIGS. 8A and 8B show an exemplary surface mounting arrangement for the getter.
Figure 8A:
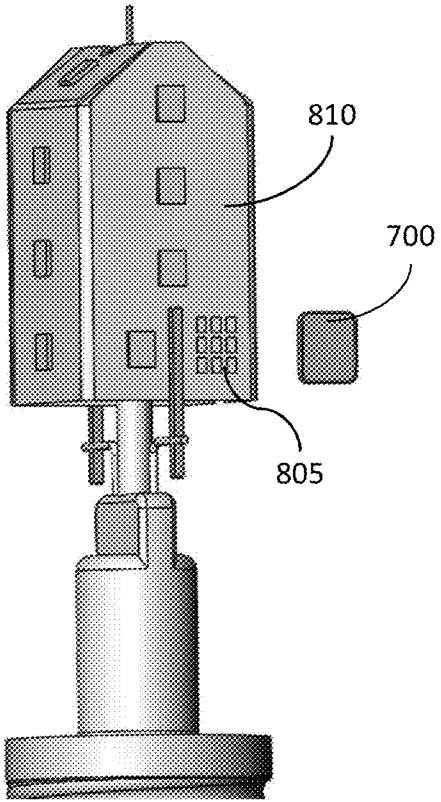
Figure 7:
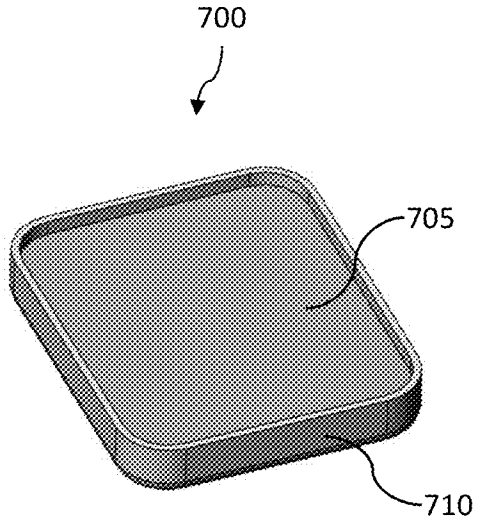
FIG. 7 illustrates an exemplary getter according to the disclosed embodiments.

Referring to FIG. 7, a getter 700 may be used to maintain the helium to oxygen ratio within the envelope. In at least one embodiment, the getter 700 may include an oxygen generating material 705 in a container 710. The getter 700 may have a rectangular shape or any shape suitable for use in the disclosed embodiments. The oxygen generating material 705 may include a chlorate, a perchlorate, an inorganic superoxide, or any other composition suitable for generating oxygen over the life of the LED lamp 100. The container may include any suitable rigid or semi-rigid material suitable for confining the oxygen generating material 705. FIGS. 8A and 8B show an exemplary surface mounting arrangement for the getter 700. In FIG. 8A, a number of mounting pads 805 are applied or otherwise provided on a surface of an LED mounting board 810. The mounting pads 805 may include an adhesive, solder, or any other suitable material for fastening the getter 700 to the LED mounting board 810. FIG. 8B shows the getter 700 fastened in position.

Figure 9D:
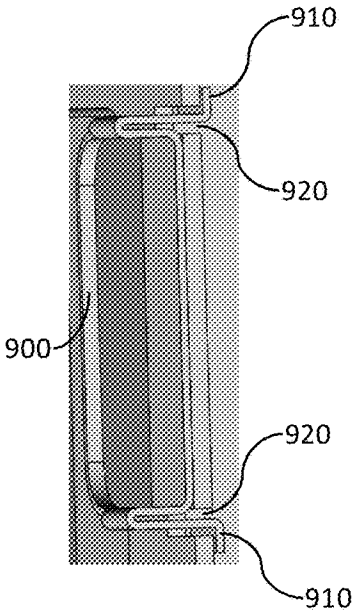
FIGS. 9A-9D illustrate another exemplary getter according to the disclosed embodiments
Figure 9C:
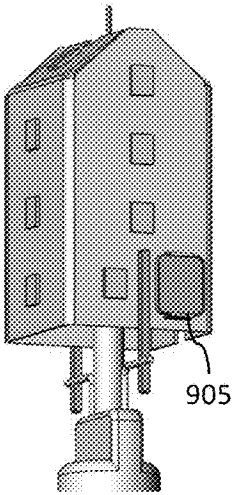
Figure 9B:
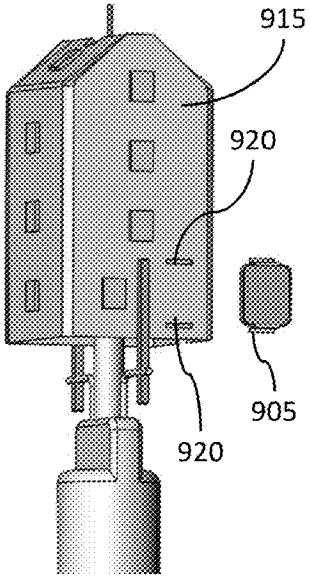
Figure 9A:
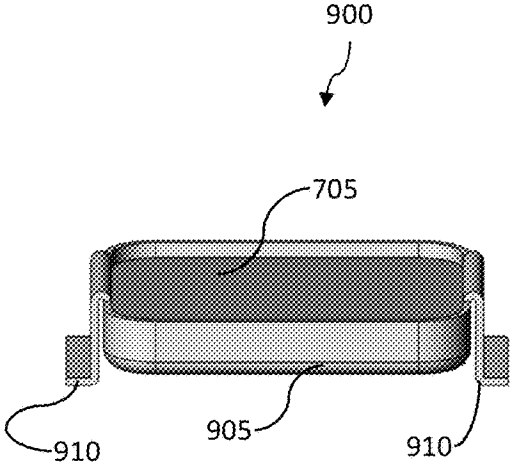

FIGS. 9A-9D illustrate another getter embodiment. Getter 900 includes oxygen generating material 705 in a container 910. FIG. 9A shows that in this embodiment, container 910 includes flanges 910 on opposing ends for mounting the container 910. FIG. 9B shows an embodiment of an LED mounting board 915 with slots 920 to receive the flanges 910. FIG. 9C shows the getter 900 fastened in position. FIG. 9D shows a cross sectional side view of the getter 900 mounted on the LED mounting board 915 with the flanges 910 extending through the slots 920.

Figure 10B:
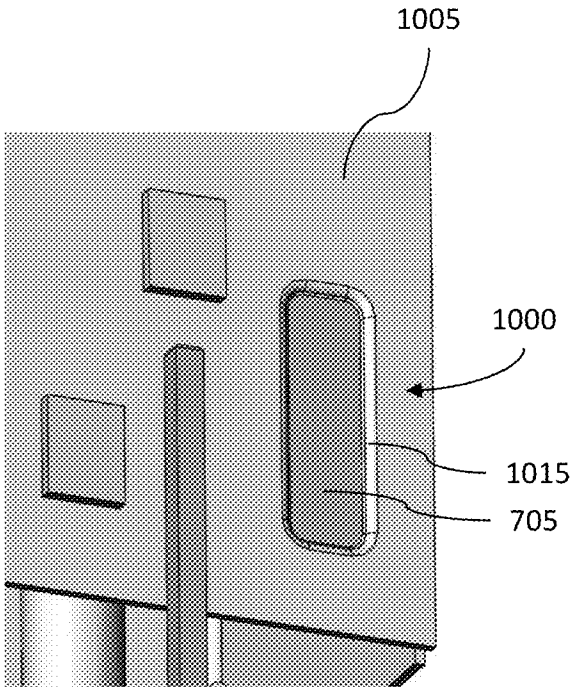
FIGS. 10A and 10B illustrate another exemplary embodiment of a getter.
Figure 10A:
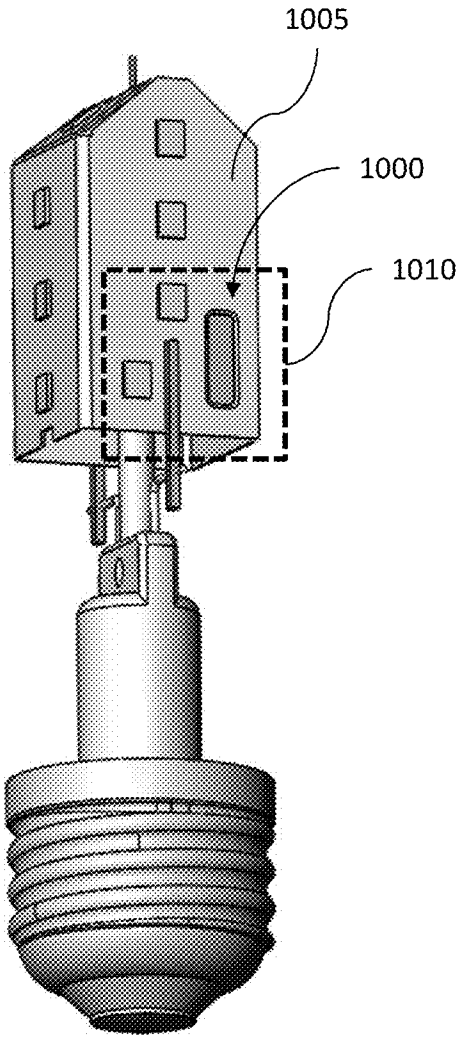

FIGS. 10A and 10B illustrate yet another exemplary embodiment where a getter 1000 is integrated with an LED mounting board 1005. FIG. 10B shows an expanded view of portion 1010 of the LED mounting board 1005. The getter 1000 may be implemented by depositing the oxygen generating material 705 on a surface of the LED mounting board 1005. In some embodiments, a recess 1015 may be provided on a surface of the LED mounting board 1005 into which the oxygen generating material may be placed.

Figure 11B:
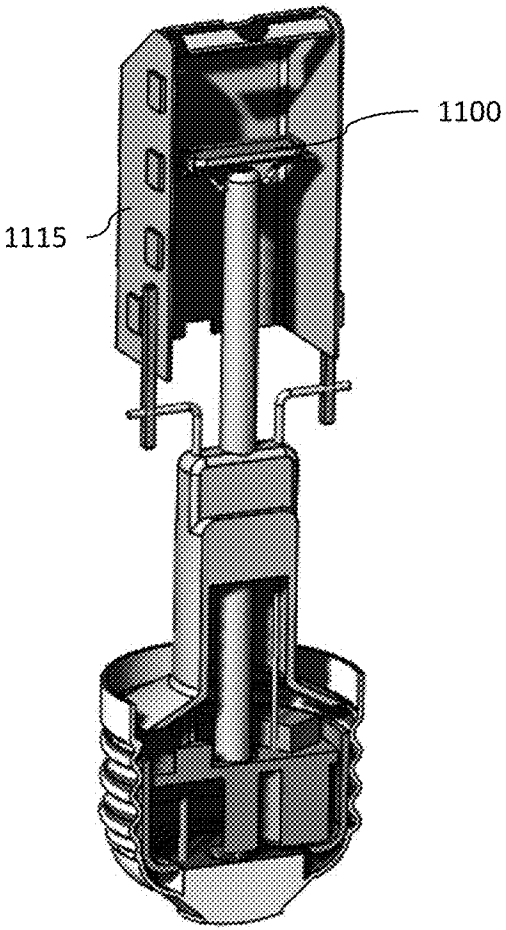
Figure 11A:
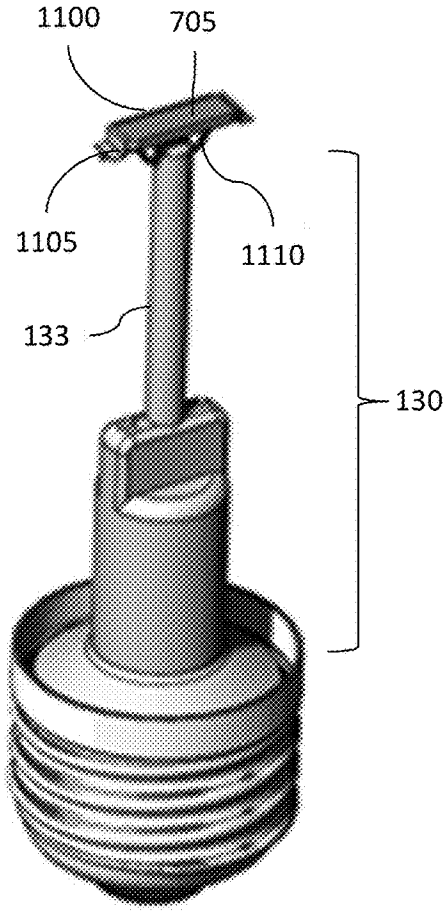

As shown in FIGS. 11A and 11B, the getter 1100 may be mounted on the stem arrangement 130, for example, mounted to the first support 133 of the stem arrangement 130. The getter 1105 may be mounted using one or more struts 1110, an adhesive, or any other suitable mechanism for positioning the getter 1100 on the stem arrangement 130. As shown in FIG. 11B, the LED mounting board 1115 may enclose at least a portion of the getter 1100 when mounted on the stem arrangement 130. In some embodiments, the LED mounting board 1115 may substantially surround the getter 1100.

Figure 12:
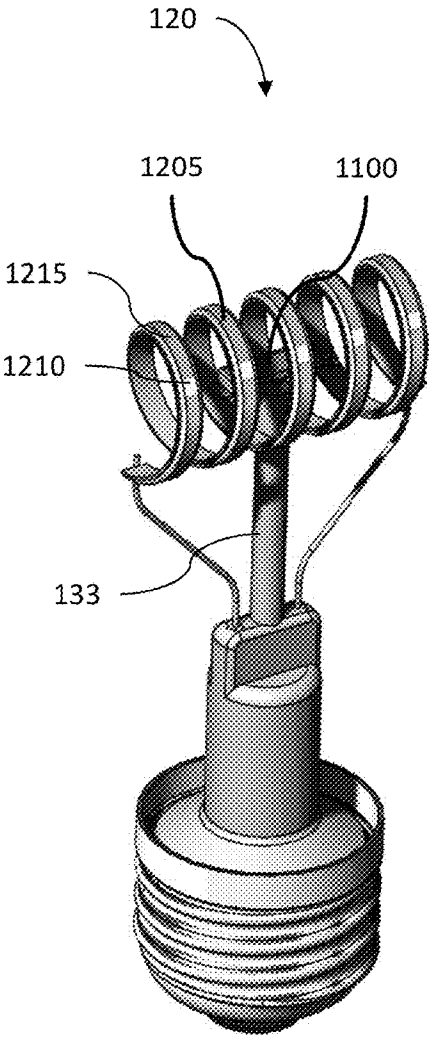
FIGS. 11A, 11B, and 12 show an exemplary getter mounted on a stem arrangement.

FIG. 12 illustrates an exemplary embodiment where the LED platform 120 comprises an LED filament arrangement 1205. In this embodiment, the getter 1100 may be mounted on a portion the stem arrangement 130, such as first support 133 of the stem arrangement 130, within the LED filament arrangement 1205. The LED filament arrangement 1205 may include a number of LED dies 1210 positioned along a substrate 1215. The LED filament arrangement 1205 may at least partially surround the getter 1100 in this embodiment.

Figure 13B:
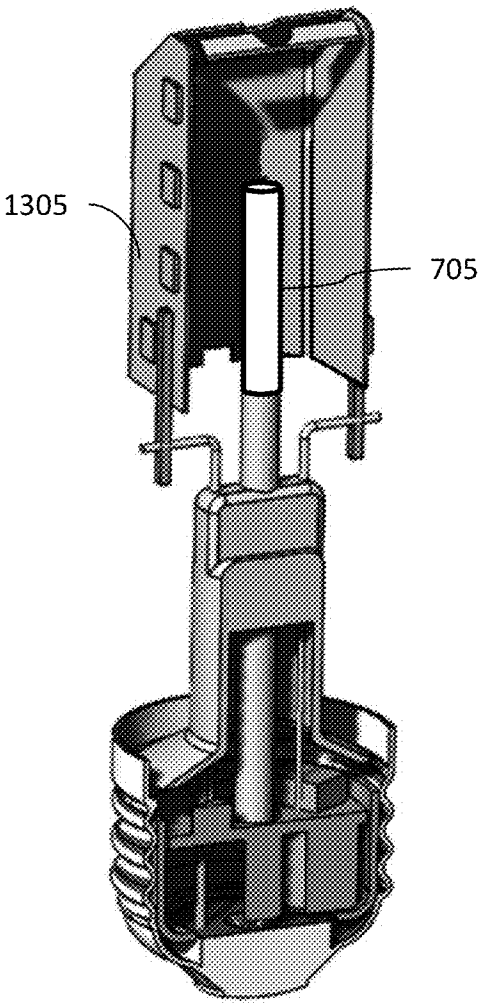
FIGS. 13A and 13B illustrate an embodiment of a getter implemented as a coating of an oxygen generating material.
Figure 13A:
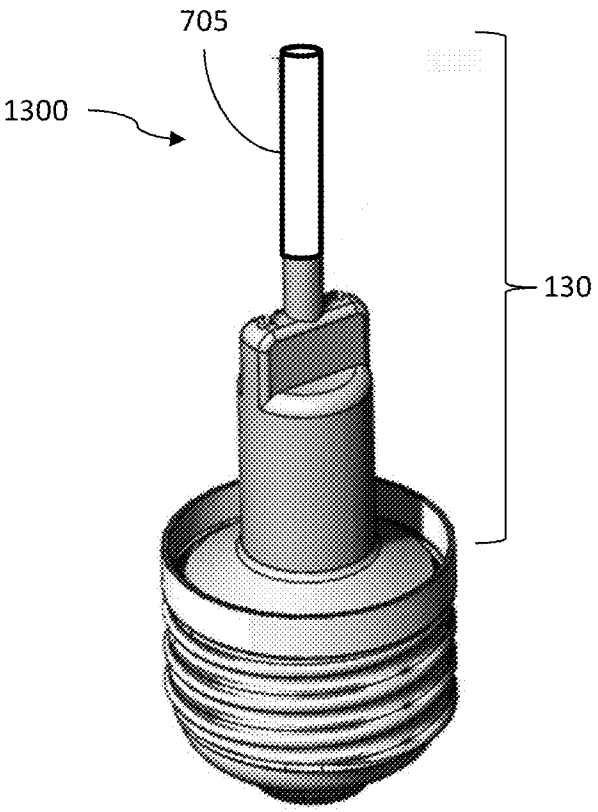

FIGS. 13A and 13B illustrate an embodiment where the getter 1300 may be implemented as a coating of the oxygen generating material 705 on the stem arrangement 130. The coating may be applied using any appropriate technique so long as the oxygen generating characteristics are maintained and the oxygen generating material 705 remains on the stem arrangement 130. As shown in FIG. 13B, when the getter 1300 is mounted on the stem arrangement 130, the LED mounting board 1305 may at least partially enclose at least a portion of the getter 1300, or may substantially surround the getter 1300.

As disclosed herein, the getters 700, 900, 1000, 1100, 1300 may be temperature activated. For example, in some embodiments, the oxygen generating material 705 may begin generating oxygen upon reaching a threshold temperature. Furthermore, the oxygen produced by the oxygen generating material 705 may increase as the ambient temperature increases. At the same time, it would advantageous to maintain a ratio of helium to oxygen that achieves both an acceptable thermal conductivity and an acceptable lumen output over the life of the LED lamp, as disclosed above. In some embodiments, the ratio of helium to oxygen may be maintained by regulating the temperature within the envelope 110. Furthermore, in at least one embodiment, the temperature within the envelope may be maintained between approximately 80° C. and approximately 90° C.

In one or more embodiments, the dimensions of the LED platform 120, when implemented as LED mounting boards 121, 505, 810, 915, 1005, 1115, 1305, may be selected such that upon the lamp 100 reaching operating temperature, the heat dissipation of the mounting boards 121, 505, 810, 915, 1005, 1115, 1305 maintains the temperature of the getter within a range that provides the ratio of helium to oxygen that achieves both an acceptable thermal conductivity and an acceptable lumen output over the life of the LED lamp. Furthermore, the dimensions of the LED platform 120 may be selected such that the dimensions of the mounting boards 121, 505, 810, 915, 1005, 1115, 1305 may enhance convective heat transfer within the envelope 110 to maintain a consistent temperature throughout the interior of the envelope 110.

Returning to FIG. 4, In some embodiments, one or more of the circuit layers 405, conductors 410, thermally conductive dielectric layers 415, and metal layer 420 may be constructed with dimensions such that, upon the lamp 100 reaching operating temperature, the heat dissipation of these components maintains the temperature of the getter within a range that provides the ratio of helium to oxygen that achieves both an acceptable thermal conductivity and an acceptable lumen output over the life of the LED lamp 100.

Referring to FIG. 12, at least one of the dimensions of the LED platform, implemented as the LED filament arrangement 1205, and the current through the LED filament arrangement 1205 may be selected to maintain a particular ambient temperature range within the envelope in order to sustain the ratio of helium to oxygen that achieves both an acceptable thermal conductivity and an acceptable lumen output over the life of the LED lamp 100.

Figure 14:
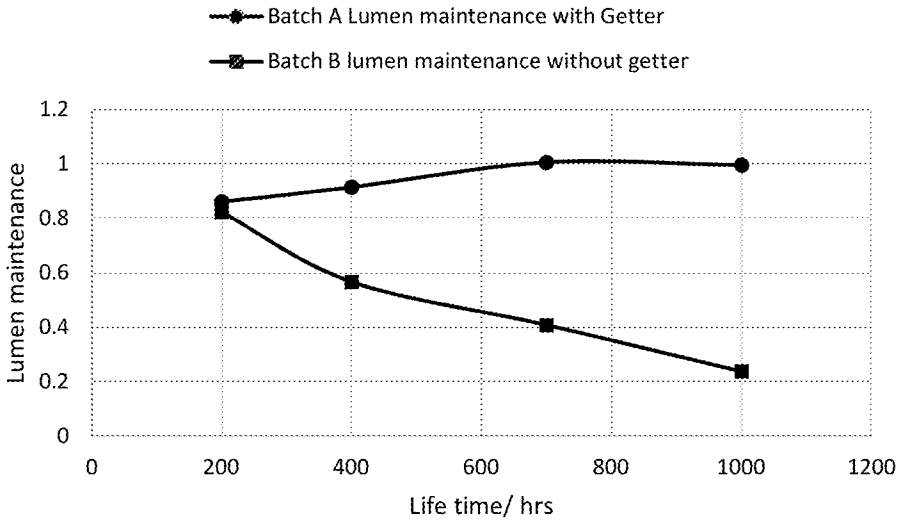
FIG. 14 illustrates an improvement in lumen maintenance provided by the addition of the getter.

FIG. 14 demonstrates an improvement in lumen maintenance provided by the addition of the getter 700, 900, 1000, 1100, 1300. Both batch A and B utilize an LED mounting board 121, 505, 810, 915, 1005, 1115, 1305 in an atmosphere of helium and oxygen within a glass envelope. In both batches, the LEDs are driven at 50 ma. Lumen maintenance is shown on a normalized scale of 0 to 1. The lumen output of Batch B, without a getter, degrades to approximately 20% over 1000 hours while the lumen output of Batch A, with a getter as disclosed herein, is maintained or improves somewhat.

Each of the embodiments of the LED mounting boards 121, 505, 810, 915, 1005, 1115, 1305 and the LED filament arrangement 1205 may be sized to fit through the smallest dimension of the envelope 110, while also providing a surface area that affords both an enhanced optical distribution and an enhanced thermal distribution. In particular, the various LED arrangements provides an almost $4\pi$ light distribution along with better thermal spreading and transfer of heat to the envelope.

Because the LED mounting boards 121, 505, 810, 915, 1005, 1115, 1305 and the LED filament arrangement 1205 meet the size limitations of the envelope, a manufacturing process similar to the halogen bulb finishing process may be achieved. For some embodiments, existing production lines may be utilized for manufacturing with only slight modifications to the process (i.e. fill-gas changes and flame adjustments).

Using a helium-oxygen filled envelope in one or more embodiments enables efficient and fast transport of the heat away from the LEDs to the surface of the envelope and thus to the outside environment, while maintaining the lumen output of the LEDs. Low atomic mass gas cooling using a selected ratio of helium to oxygen provides operating temperatures within specified bounds of LED operation. Effective heat transport has been demonstrated at fill pressures as low as approximately 50 Torr, however any suitable fill pressure may be utilized.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. An LED lamp assembly, comprising:

a glass envelope;

an LED platform supported by a stem arrangement disposed within the envelope;

a base hermetically sealed to the envelope;

a gas disposed within the envelope providing thermal conductivity between the LED platform and the envelope; and a getter disposed within the envelope for absorbing volatile organic compounds and comprising an oxygen-generating material for generating oxygen.

2. The LED lamp assembly of claim 1, wherein the LED platform comprises a metal core printed circuit board formed into a shape with multiple sides with LED light sources mounted on exterior surfaces of the multiple sides.

3. The LED lamp assembly of claim 2, wherein the getter is mounted on at least one of the exterior surfaces of the multiple sides using one or more surface mounting pads.

4. The LED lamp assembly of claim 2, wherein the getter is mounted on at least one of the exterior surfaces of the multiple sides by one or more flanges inserted into corresponding slots of the exterior surfaces.

5. The LED lamp assembly of claim 2, wherein the getter is implemented as a deposit of the oxygen generating material in a recess on at least one of the exterior surfaces.

6. The LED lamp assembly of claim 1, wherein the getter is mounted on the stem arrangement disposed within the envelope.

7. The LED lamp assembly of claim 1, wherein the LED platform comprises an LED filament arrangement and the getter is mounted on the stem arrangement and disposed within the LED filament arrangement.

8. The LED lamp assembly of claim 1, wherein the getter is applied as a coating on the stem arrangement.

9. The LED lamp assembly of claim 1, wherein:

the gas disposed within the envelope comprises a selected ratio of helium to oxygen that achieves the thermal conductivity and provides a predetermined lumen output over a predetermined time period; and the getter generates oxygen to maintain the selected ratio.

10. The LED lamp assembly of claim 9, wherein: the getter is temperature activated; and selected dimensions of the LED platform provide a heat dissipation that maintains a temperature of the getter within a range that provides the selected ratio of helium to oxygen.

11. The LED lamp assembly of claim 9, wherein selected dimensions of the LED platform provide a convective heat transfer within the envelope to maintain a consistent temperature throughout the interior of the envelope.

12. The LED lamp assembly of claim 9, wherein the gas disposed within the envelope comprises a ratio of between 70% helium to 30% oxygen.

13. The LED lamp assembly of claim 9, wherein the gas disposed within the envelope comprises a ratio of 99.75% helium to 0.25% oxygen.

14. The LED lamp assembly of claim 9, wherein the gas disposed within the envelope comprises a range of ratios of between 70% helium to 30% oxygen and 95% helium to 5% oxygen.

15. An LED lamp assembly, comprising:

a glass envelope;

an LED platform supported by a stem arrangement disposed within the envelope;

a base hermetically sealed to the envelope;

a gas mixture disposed within the envelope having a helium-oxygen ratio for providing thermal conductivity between the LED platform and the envelope and for absorbing volatile organic compounds outgassed by components of the LED platform; and a getter comprising an oxygen generating material disposed within the envelope for maintaining the helium-oxygen ratio.

16. The LED lamp assembly of claim 15, wherein the getter is mounted to a metal core printed circuit board of the LED platform, the metal core printed circuit board comprising a shape with multiple sides and LED light sources mounted on exterior surfaces of the multiple sides.

17. The LED lamp assembly of claim 15, wherein the getter is mounted on the stem arrangement disposed within the envelope and is at least partially enclosed by the LED platform.

18. The LED lamp assembly of claim 15, wherein the getter is applied as a coating on the stem arrangement and is at least partially surrounded by the LED platform.

* * * * *